US008906438B2

(12) United States Patent
Landman

(10) Patent No.: US 8,906,438 B2
(45) Date of Patent: Dec. 9, 2014

(54) CONTAINER FOR HOLDING AND DISPENSING A PRESSURISED BEVERAGE

(75) Inventor: Bernardus Cornelis Johannes Landman, Boskoop (NL)

(73) Assignee: Heineken Supply Chain B.V., Amsterdam (NL)

( * ) Notice: Subject to any disclaimer, the term of this patent is extended or adjusted under 35 U.S.C. 154(b) by 107 days.

(21) Appl. No.: 12/936,864

(22) PCT Filed: Apr. 8, 2009

(86) PCT No.: PCT/NL2009/050184

§ 371 (c)(1), (2), (4) Date: Oct. 29, 2010

(87) PCT Pub. No.: WO2009/126034

PCT Pub. Date: Oct. 15, 2009

(65) Prior Publication Data

US 2011/0038989 A1 Feb. 17, 2011

(30) Foreign Application Priority Data

Apr. 10, 2008 (NL) ..... 2001467

(51) Int. Cl.
*B65D 81/32* (2006.01)
*B67D 1/08* (2006.01)

(52) U.S. Cl.
CPC ..... *B67D 1/0801* (2013.01); *B67D 1/0805* (2013.01)
USPC ..... 426/115; 426/234; 222/367; 222/399; 222/400.7

(58) Field of Classification Search
CPC ..... B67D 1/0801; B67D 1/0805
USPC ..... 426/115, 234; 222/396, 399, 400.7, 222/422, 400
See application file for complete search history.

(56) References Cited

U.S. PATENT DOCUMENTS

| | | | | |
|---|---|---|---|---|
| 3,251,420 | A | 5/1966 | Rodgers | |
| 3,613,954 | A * | 10/1971 | Bayne | 222/61 |
| 3,955,720 | A * | 5/1976 | Malone | 222/396 |
| 4,147,283 | A | 4/1979 | Mascia et al. | |
| 4,281,769 | A | 8/1981 | Ignell | |
| 4,402,429 | A * | 9/1983 | Vanden Driessche | 222/153.01 |
| 5,110,012 | A * | 5/1992 | Scholle et al. | 222/83.5 |
| 5,368,207 | A | 11/1994 | Cruysberghs | |
| 6,360,923 | B1 * | 3/2002 | Vlooswijk | 222/399 |
| 6,415,963 | B1 | 7/2002 | Vlooswijk et al. | |

(Continued)

FOREIGN PATENT DOCUMENTS

| | | | |
|---|---|---|---|
| CN | 1617828 | A | 5/2005 |
| CN | 1906097 | A | 1/2007 |

(Continued)

*Primary Examiner* — Rena L Dye
*Assistant Examiner* — Chaim Smith
(74) *Attorney, Agent, or Firm* — Pearne & Gordon LLP

(57) ABSTRACT

Holder (1) for beverage, comprising a container (2) manufactured substantially from plastic, provided with a neck (6) having an opening, wherein the container (2) is filled with beverage (3) and on or in the neck (6) a closure (15) is provided, through which closure extends a dispensing means (4), wherein the closure is fixed to the neck with the aid of at least welding technique and wherein a pressure device (9) is provided for pressurizing the beverage (3) in the container (2) for dispensing the beverage (3) under pressure via the dispensing means (4).

26 Claims, 5 Drawing Sheets

(56) References Cited

U.S. PATENT DOCUMENTS

| | | | | |
|---|---|---|---|---|
| 6,745,922 | B1 | 6/2004 | Vlooswijk et al. | |
| 6,942,127 | B2 | 9/2005 | Raats | |
| 7,168,596 | B2 | 1/2007 | Delbarre | |
| 7,661,564 | B2 | 2/2010 | Delbarre | |
| 7,708,171 | B2 | 5/2010 | Regan et al. | |
| 8,177,103 | B2 | 5/2012 | Pakkert et al. | |
| 8,684,240 | B2 | 4/2014 | Sauer et al. | |
| 2004/0020947 | A1 | 2/2004 | Delbarre | |
| 2005/0045662 | A1 | 3/2005 | Raats | |
| 2005/0230435 | A1 | 10/2005 | Delbarre | |
| 2005/0269359 | A1 | 12/2005 | Raats | |
| 2006/0201829 | A1 | 9/2006 | Muhlemann | |
| 2007/0114249 | A1 | 5/2007 | Schneider et al. | |
| 2007/0125809 | A1 | 6/2007 | Regan et al. | |
| 2008/0099511 | A1 | 5/2008 | Schneider et al. | |
| 2008/0116230 | A1 | 5/2008 | Pakkert et al. | |
| 2008/0203118 | A1 | 8/2008 | Sauer et al. | |
| 2008/0217361 | A1 * | 9/2008 | Vitantonio et al. | ..... 222/399 |
| 2009/0272712 | A1 | 11/2009 | Muhlemann | |
| 2009/0302069 | A1 | 12/2009 | Oberhofer et al. | |

FOREIGN PATENT DOCUMENTS

| | | | | |
|---|---|---|---|---|
| EP | 1064221 | A1 | 1/2001 | |
| EP | 1140692 | A1 | 10/2001 | |
| EP | 1140658 | B1 | 11/2002 | |
| EP | 1504999 | A1 | 2/2005 | |
| EP | 1642861 | A1 | 4/2006 | |
| EP | 1688814 | A1 | 8/2006 | |
| JP | 2002506782 | A | 3/2002 | |
| NL | 1011570 | C2 | 9/1999 | |
| NL | 1008601 | A | 4/2004 | |
| RU | 2063915 | C1 | 7/1996 | |
| WO | 95/11855 | A1 | 5/1995 | |
| WO | 9950383 | A2 | 10/1999 | |
| WO | 0238457 | A1 | 5/2002 | |
| WO | 2005007560 | A2 | 1/2005 | |
| WO | 2005009862 | A1 | 2/2005 | |
| WO | WO 2005/082744 | * | 9/2005 | ..... B65D 83/14 |
| WO | 2005095229 | A1 | 10/2005 | |
| WO | 2007/064277 | A1 | 6/2007 | |
| WO | 2007/108683 | A1 | 9/2007 | |

* cited by examiner

CONTAINER FOR HOLDING AND DISPENSING A PRESSURISED BEVERAGE

The invention relates to a device for storing beverage.

Beverage such as carbonated beverage, for instance soft drink or beer, can be offered in, for instance, bottles, cans or kegs. When the beverage is packaged in a plastic bottle, usually a blown plastic bottle is used, having a neck which is closed off by a screw cap. For pouring out the beverage, the cap is unscrewed, whereupon a part of the beverage can be poured out and the cap can be screwed back onto the neck again.

When beverage is packaged in a can or keg, usually an external pressure source is used, such as for instance a gas cylinder and dosing device for regulating pressure in the can or keg. The beverage is then dispensed under pressure via a tapping device configured for that purpose.

From EP 1064221 a device is known where in a plastic or metal container a pressure regulator is provided, which is for instance glued onto the bottom of the container or suspended from the cover.

An object of the invention is to provide a holder for beverage which is simple in structure and use. Another object of the invention is to provide a holder for beverage with which beverage can be dispensed under pressure. A further object of the invention is to provide a holder for beverage in which the beverage is protected from outside influences, such as contamination. These and/or other objects can be achieved with a holder or method according to the invention.

In a first aspect, a holder for beverage according to this specification is characterized by a container manufactured substantially from plastic, provided with a neck having an opening, wherein the container is filled with beverage and on or in the neck a closure is provided. Through the closure extends a dispensing means. The closure is fixed to the neck utilizing at least welding technique. A pressure device is provided for pressurizing the beverage in the container for dispensing the beverage under pressure via the dispensing means.

In another aspect, a holder according to this specification is characterized in that in the holder a pressure regulator is suspended, with the aid of the closure, such that it is preferably suspended eccentrically of the neck, such that a filling pipe can be inserted into the holder alongside the pressure regulator, through the neck, for filling the holder.

In clarification of the invention, embodiments of a holder or dispensing device and parts thereof and methods will be further elucidated with reference to the drawing. In the drawing.

Figure 5:
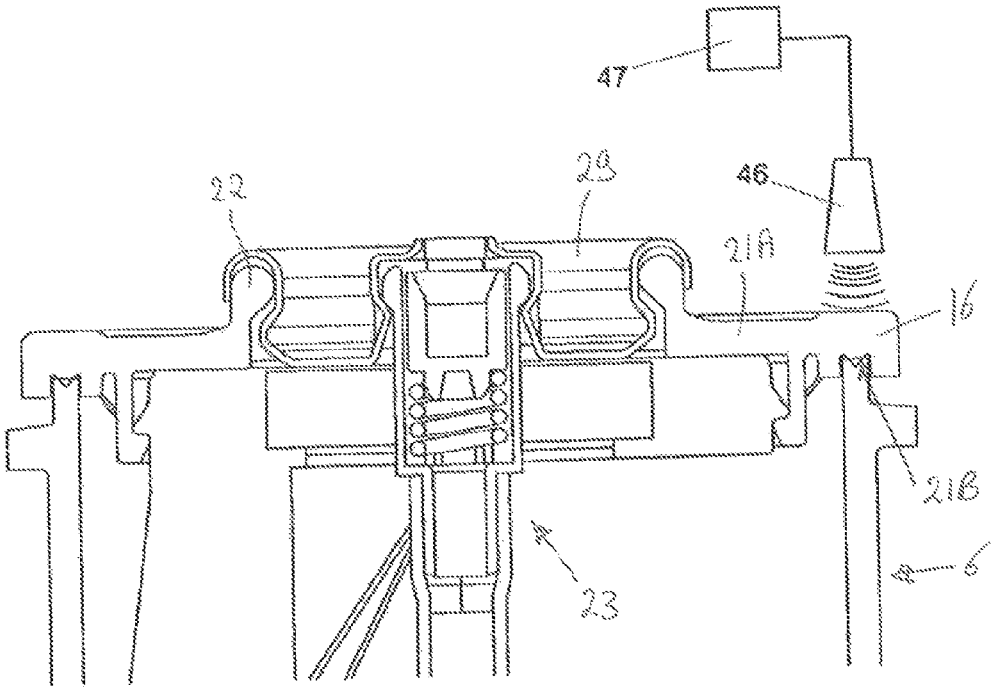

FIG. 5 schematically shows a portion of a holder according to the invention, with a pressure device being fixed onto the holder with the aid of a welding device, in particular an ultrasonic welding device.

In this description the same or corresponding parts have the same or corresponding reference numerals. The embodiments shown are shown only by way of illustration and should not be construed in any way as limiting. In this description, examples will be discussed and shown for dispensing beer, in particular lager-type beer. However, also other types of beverage can be dispensed from a device according to this specification. In this description the designation "lower" designates a side of a holder which is represented at the bottom in the figures. The designation "upper" is accordingly to be understood as being the opposite side.

Figure 1:
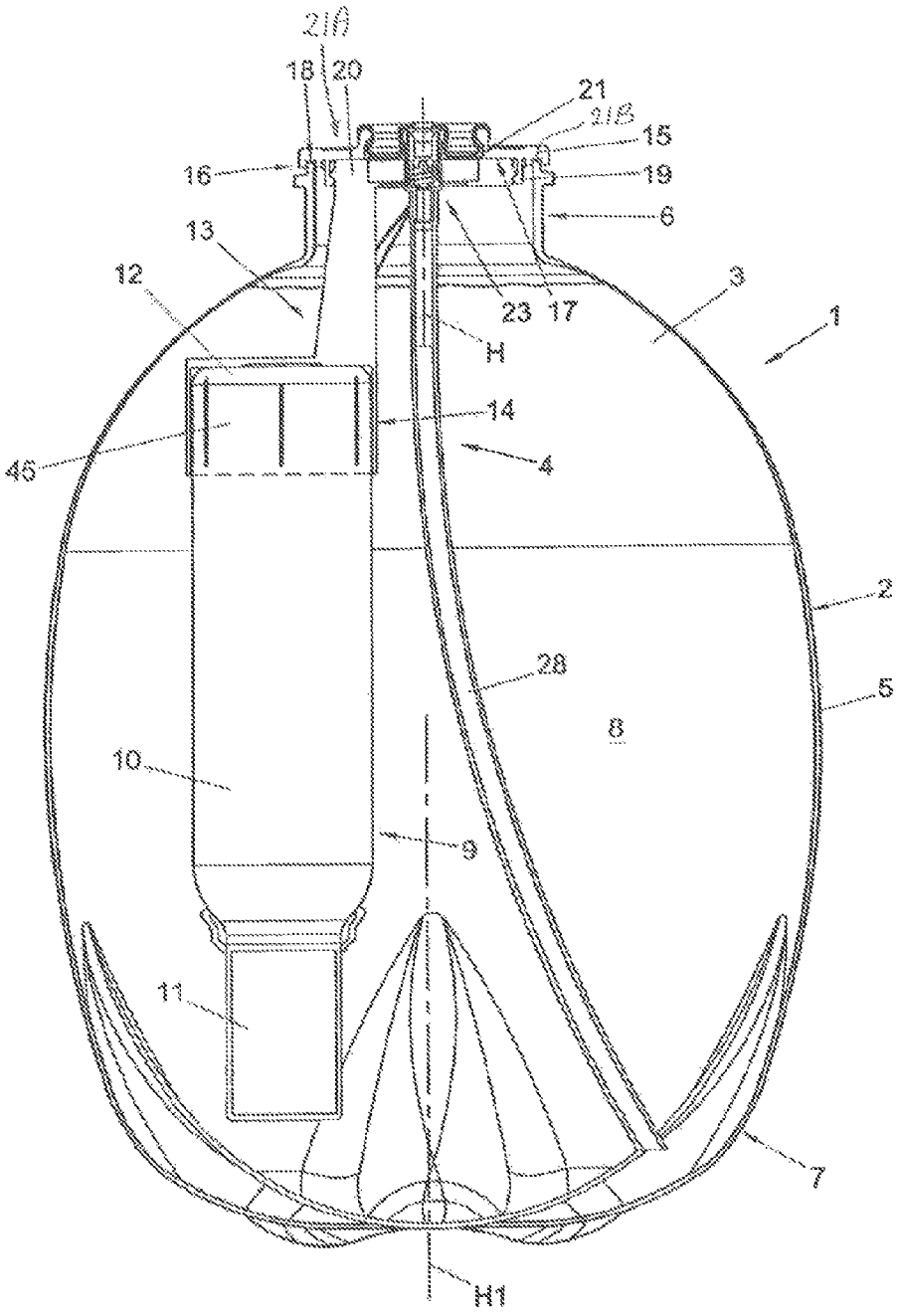
FIG. 1 shows in partly sectional side elevation a first embodiment of a holder.

FIG. 1 shows schematically and in partly sectional side elevation a holder 1, comprising a container 2, for instance wholly or partly filled with beverage 3, and a dispensing device 4. The beverage 3 can be beer. In an embodiment, the holder container 2 may be formed as a blown plastic bottle. In another embodiment, the container 2 may be rotation molded, injection molded or otherwise manufactured wholly or partly from plastic. The container 2 is provided with a body 5, a neck 6 and a bottom 7. The bottom 7 may for instance be a "petal" bottom having for instance three, four or five supporting feet. In this way, a self-standing bottle can be obtained, which can moreover be resistant to relatively high internal pressures, for instance five bars or more. In another embodiment, the bottle may for instance be provided with a stand ring (not shown) on which the bottle can stand. This ring may for instance be formed-on, glued-on, clamped-on, integrally injection molded or provided otherwise. The body 5 may be global so as to be able to resist internal pressure in a simple manner. However, it can also have a different shape. The body 5, the bottom 7 and the neck 6 substantially define an inner space 8, in which the beverage 3 is received. In the inner space 8 extends, substantially, the dispensing device 4.

Figure 2:
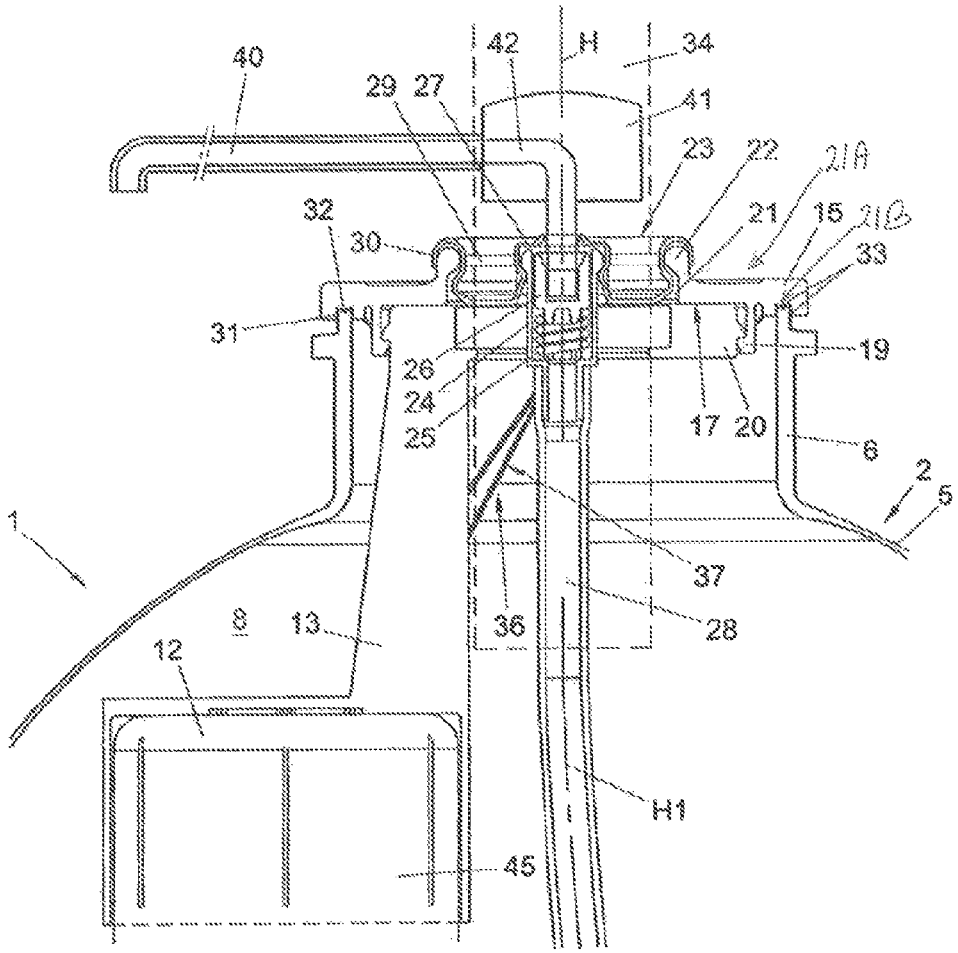
FIG. 2 shows in magnification a portion of a holder according to FIG. 1, with a schematically represented dispensing tube.
Figure 3:
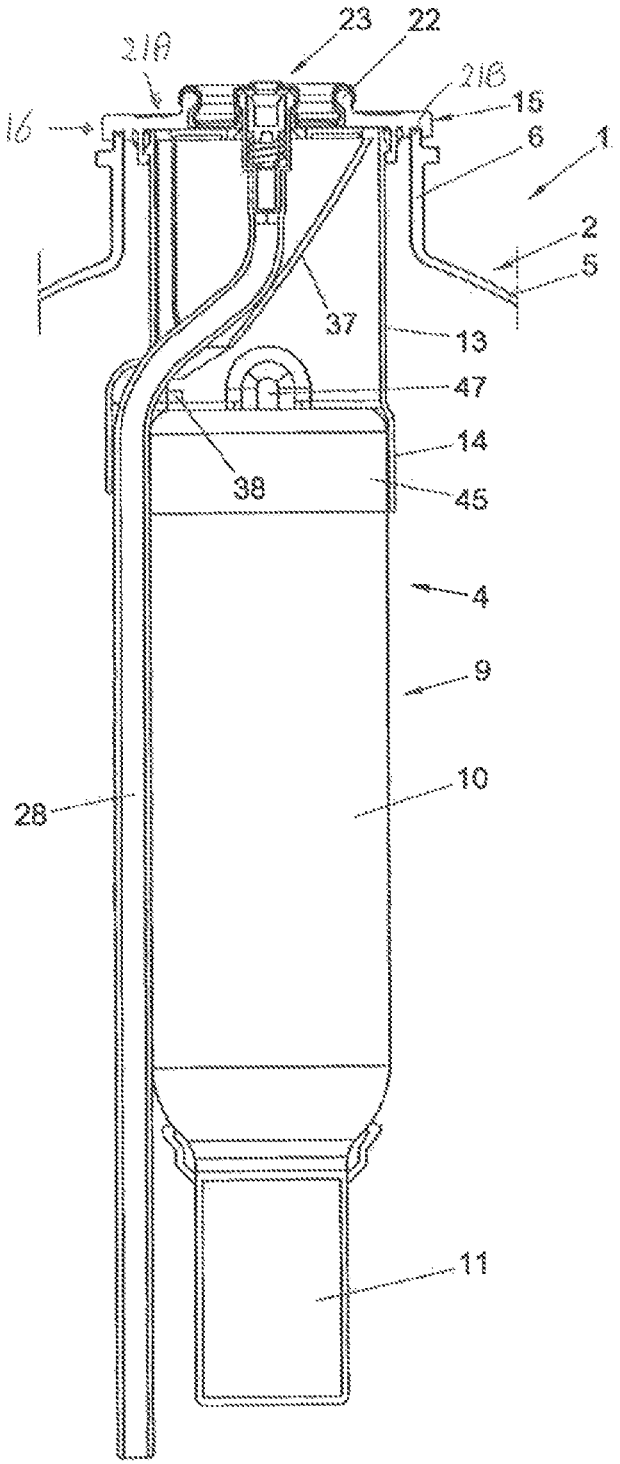
FIG. 3 shows in partly sectional side elevation a second embodiment of a holder.

The dispensing device 4 in this embodiment comprises for instance a device as known from NL 1008601, for instance as shown in FIGS. 1 to 3 thereof. Other examples of possible embodiments of dispensing devices 4 and/or pressure devices 9 to be used therein are for instance known from EP 1 140 658, WO 2005/095229, EP 1 642 861, U.S. Pat. No. 5,368,207 or from the non-prepublished patent applications of applicant, titled "Pressure regulator and tapping apparatus provided therewith" or "Tapping apparatus, provided with a pressure regulating device", filed on Mar. 31, 2008. These devices 4, 9 are mentioned only by way of illustration, should not be construed in any way as limiting, and are all configured, on the basis of the internal pressure in the inner space 8 and/or through operation by a user, to regulate the pressure in the inner space 8 through introduction of gas under pressure from a storage reservoir 10 into the inner space 8, controlled by a pressure regulating device 11.

A pressure device 9 in the embodiment shown comprises an aerosol container 10 as a storage reservoir, closed off by an aerosol valve (not shown). A pressure-controlled regulating unit 11 as a pressure regulating device is fixed on the aerosol container 10, such that the aerosol valve can be opened by the regulating unit 11 if the pressure in the inner space 8 falls below a desired pressure. Preferably, as a result, the pressure device 9 operatively regulates the pressure in the inner space to an equilibrium pressure of $CO_2$ in the beverage, at a desired temperature, for instance a pressure between approximately 1.2 and 2 bar absolute, more particularly between approximately 1.4 and 1.6 bar between for instance 0 and 15° C., for instance at approximately 6° C. For instance for beverages other than beer, of course, in each case a suitable pressure can be set.

In the embodiment shown in FIG. 1, the pressure device 9 with the container 10, which may for instance be manufactured from metal, is suspended by a bottom 12 from the side of the neck 6. The regulating unit 11 in the position shown in FIG. 1 is hence directed downwards, facing towards the bottom 7. It will be clear, however, that the actual position during use naturally also depends on the orientation of the holder 1.

In FIG. 1 the latter is set up on the bottom 7. The pressure device 9 is suspended in a bracket 13, for instance manufactured from plastic, which bracket 13 comprises a clamping ring 14 which can clampingly embrace a part 45 of the container 10 contiguous to the bottom 12. In another embodiment, the container 10 or pressure device 9 as such may be fixed to the bracket 13 in a different manner, for instance by gluing, by cooperating clamping means on the bracket 13 and/or the container 10 and/or the regulating unit 11.

On the side of the neck 6 the bracket 13 is attached to or provided with a suspension ring 15. In an embodiment, the suspension ring 15 is substantially disc-shaped and rests by an edge 16 at the lower side 17 on an upper side 18 of the neck 6. At the lower side 17 of the suspension ring 15, a clamping ring 19 is provided, within the neck 6, in which a ring 20 which is attached to the upper side of the bracket 13 is clamped. In another embodiment, the bracket 13 may be formed integrally with the suspension ring 15 or be fixed thereto in a different manner, for instance by welding, gluing, snap-fitting, screws or otherwise.

The suspension ring 15 is provided with a central opening 21, around which, at the upper side of the ring 15, an edge 22 extends. As is clearly visible in FIG. 2, a valve 23, in particular an aerosol valve type valve 23, is arranged, as is also used in, for instance, a Tapvat™ keg of Heineken, Netherlands, and as described, for instance, in EP 99960036.4. In the embodiment shown, the valve 23 is provided with a sleeve 24 in which a spring 25 is supported. The spring 25 presses a valve body 26 against a valve seat 27, for instance a plastic or rubber ring. When the valve body 26 is pushed down, off the seat 27, beverage can pass the valve body 26 and be dispensed. Attached to the sleeve 24 at the lower side is a riser 28, which extends to a point near the bottom 7. The sleeve 24, which may for instance be made of metal, is fixed in a clinch plate 29. The clinch plate 29 is fixed by an outer edge 30 thereof over the edge 22. The outer edge 30 may for instance be clinched over the edge 22. Surprisingly, this has been found to be very well possible when the clinch plate 29 is manufactured from metal such as steel or aluminum and the ring 15 from plastic.

The suspension ring 15 is provided, at the lower side 17, with a groove 31 which can be slid over the upper side 18 of the neck 6 with a relatively close fit. Within the groove 31, an edge 32 may be provided, for instance an edge 32 having a slightly pointed cross section, for instance substantially triangular or parabolic. As a result, the suspension ring 15, when laid onto the upper side 18 of the neck, will be supported on the edge 31, so that a relatively small contact surface is obtained. The edge 32 preferably has a height that is smaller than the depth of the groove 31, so that in that position the groove 31 has respective longitudinal edges 33 abutting against the inside and outside of the neck 6, which is thereby properly positioned. In this condition, the suspension ring 15 can be fixed onto the neck 6. To that end, preferably, use is made of a welding technique, such that a part of the material of the neck 6 and/or the suspension ring 15, including the edge 32, if present, melts at least partly. As a result, a good contact surface is obtained and upon cooling of the material a firm connection between the neck and the suspension ring 15 will be obtained. In an advantageous embodiment, use is made of ultrasonic welding technique, as schematically represented in FIG. 5, in which schematically a horn (loudspeaker) 46 of an ultrasonic welder 47 is directed at the suspension ring 15 and neck 6. An advantage of use of welding technique, in particular ultrasonic welding technique, is that it will yield particularly good connections, also when for instance parts of the ring 15 and/or the neck 6 are moist, for instance as a result of filling of the container 2 with beverage. As a consequence, the connection can also be obtained after the holder has been filled. The connection is preferably not reversible. This means that a user cannot open the holder, for instance, by separating the suspension ring 15 from the neck. In this way, the chance of contamination or any other tampering with the beverage is prevented. The suspension ring 15 forms a closure. The suspension ring can have a central area 21A around the opening 21 that is thinner than the edge 16. The central area 21A can form a closing surface 21B, with the edge 16 possibly standing up from the central area 21A. The central area and the edge can form a flange 15A of the closure.

In the embodiment shown in FIGS. 1 and 2, the suspension bracket 13 is so designed that the pressure device 9 is suspended in a position offset with respect to a centerline H of the neck 6 and, in the embodiment shown, the longitudinal axis or centerline $H_1$ of the holder 1. To this end, the clamping ring 14 is mounted eccentrically to the bracket 13. The pressure device 9 may for instance be suspended such that a filling pipe 34 (shown in broken lines in FIG. 2) of a filling installation (not shown) can be inserted through the opening 21, parallel to the longitudinal axis $H_1$ of the neck 6 and/or holder 1, without the pressure device 9 being touched thereby. This provides the advantage that the pressure device 9 can also be placed prior to filling of the holder 1, without the filling device needing to be adapted. A filling pipe 34 can be inserted into the holder 1 to a point near the bottom 7. After filling, the valve 23 can then be arranged and fixed, for instance by clinching or otherwise. The neck 6 preferably has a circular cross section with a radius of more than 13 mm or a passage area with a cross-sectional surface of more than 530 $mm^2$. The radius can for instance be between about 13 and about 20 mm, preferably between about 13 mm and 16 mm, or the surface may be of comparable proportions. In this way, the pressure device 9 with sufficient volume can be simply introduced through the neck 6 while the container 10 thereof may be cylindrical. Owing to the welding technique, in particular ultrasonic welding, no screw cap needs to be used.

In the embodiment shown in FIGS. 1 and 2, between the bracket 13 and the suspension ring 15, at least one rising surface 36 is provided, having an inclining edge 37. Viewed in side elevation, a rising surface 36 for instance extends from approximately near the longitudinal axis H of the neck adjacent the suspension ring 15 to the suspension bracket 13 approximately adjacent a middle of the bracket 13, viewed in the height direction of the holder 1. The or each rising surface 36 is preferably so arranged that if the pressure device 9 is inserted through the neck 6 and, for instance, released, the pressure device 9 is forced into the inner space 8 under the influence of gravity and at the same time is pushed to the side by the rising surfaces 36 until the suspension ring 15 butts against the neck 6. In this way, the pressure device 9 is particularly simply and substantially automatically brought into the correct position.

In the embodiments shown, the suspension ring 15 is supported on the upper side of the neck 6. An advantage of such a construction may be that the pressure device can be brought to its position by gravity and will not fall farther into the container. Moreover, this can simplify welding. However, naturally also other configurations can be used, so long as the suspension means and the neck 6 are mutually weldable.

In FIG. 2 there is schematically shown a dispensing tube 40 which via an operating button 41 with a channel part 42 is inserted into the valve 23, in particular into the valve body 26. When the operating button 41 is pressed down, the valve 23 is opened and beverage can be dispensed from the inner space 8, via the dispensing tube 40.

Figure 4:
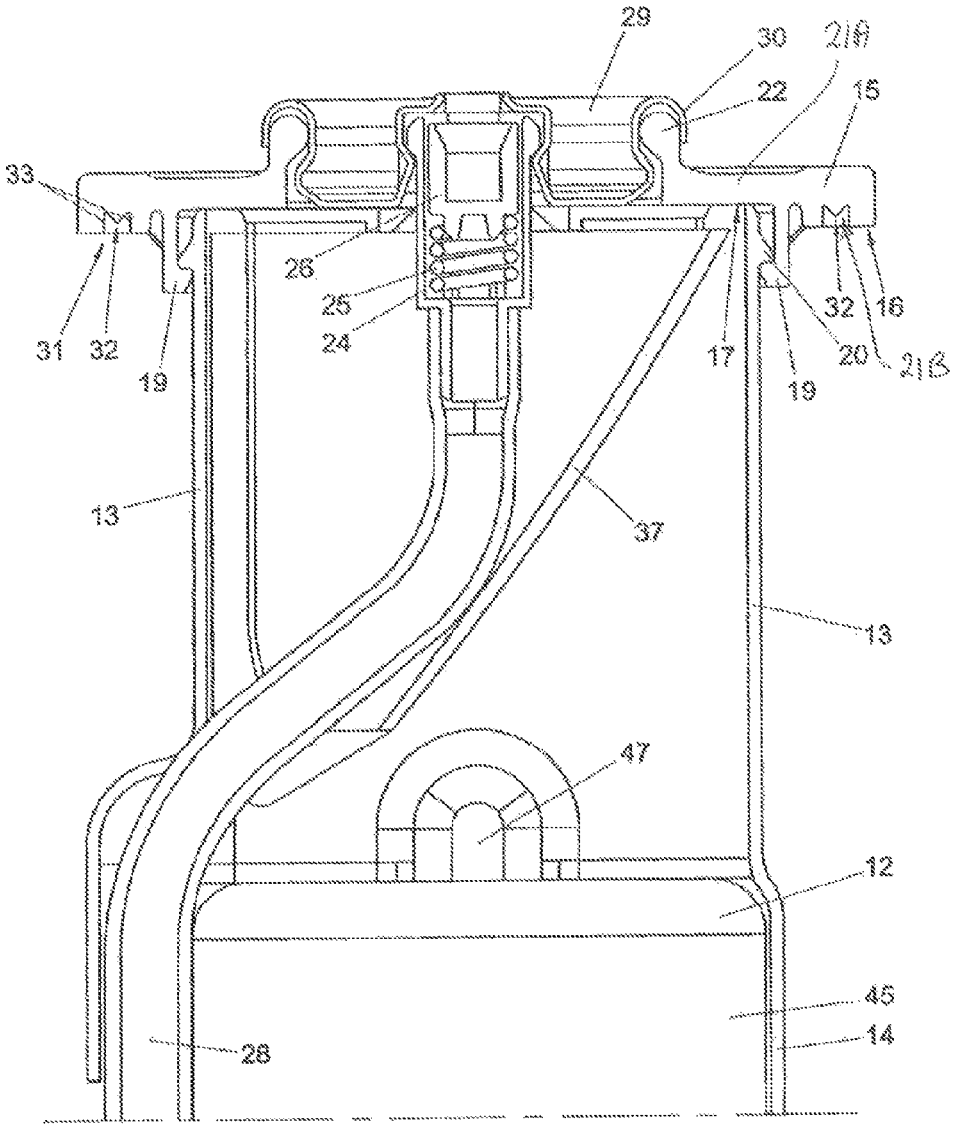
FIG. 4 shows in magnification a portion of a holder according to FIG. 3.

In FIGS. 3 and 4 an alternative embodiment is shown of a part of a holder 1 according to the invention. In broad outline, it is equal to the holder according to FIGS. 1 and 2, however, the pressure device 9 is suspended straight under the neck 6. Again, the suspension ring 15 is fixed onto the neck 6, in particular by welding technique, more particularly by ultrasonic welding. The bracket 13 in this embodiment is substantially tubular, with an inclined surface 37 being arranged, such that when a riser 28 is inserted through the opening 21, it is pushed aside and bent, such that it is simply forced alongside the pressure device 9 and at least alongside the container 10. An opening 38 may be provided near a lower side of the surface 37, to which a tube 39 is connected which guides the riser in the right direction. The container may be filled prior to placement of the pressure device but may also be filled through the opening 21. Openings 47 are provided, through which the beverage such as beer can flow, via the tubular bracket 13, into the inner space 8.

In an embodiment, the holder 2 or at least the neck 6 thereof may be manufactured from a weldable, in particular an ultrasonically weldable plastic, such as for instance PET, PEN, PE, PP or the like, which plastic is moreover preferably recyclable. It is preferred to use a plastic allowing the container 2 to be blown from it, in particular with a relatively thick wall thickness, being for instance, though no limited to, thicknesses between a few tenths of millimeters and a few millimeters, in order to obtain a container 2 which is pressure-resistant at the earlier-mentioned pressures or higher. The suspension ring 15 may be manufactured from a plastic compatible therewith. Compatible should herein be understood to refer to a plastic that is weldable, in particular ultrasonically weldable, with the plastic of the neck 6. In an embodiment, the container 2 and the suspension ring 15 are manufactured from PET or a blend thereof. The bracket 13 may be manufactured from a different plastic or the same plastic. The whole suspension of the pressure device in the container 2 may also be manufactured, for instance, by 2K, or more K, injection molding. These examples merely serve for illustration and should not be construed in any way as limiting.

In an advantageous embodiment, the suspension ring 15 is at least partly translucent, in particular in that part where the suspension ring 15 is connected with the container 2. In this way, the weld between the suspension ring 15 and the container 2, in particular the neck 6, can be simply checked, in particular optically, for instance by visual inspection. Such an inspection can be carried out with the naked eye but can also be carried out, for instance, by a camera such as a CCD camera and image recognition software. Also, other systems known per se from practice may be used to check such welds (semi)automatically. Herein, translucent should be understood to mean at the least, though not exclusively so, transmissive of a light frequency suitable for checking the joint mentioned.

In the description an example has been given of a configuration of the cooperating edge of the suspension ring and the neck of the container, in particular an upper side thereof. Many variations thereon are possible, as for instance known from publications of the firm of Sonitek—Sonic & Thermal Technologies, Inc, Milford. These and comparable configurations can be used in a holder 1 according to the invention. A choice from the possible configurations can be readily made by one skilled in the art, depending on the specifications chosen. In an exemplary embodiment, the suspension ring 15 at the edge 17 had a thickness of 3.0 mm, the edge 32 having an approximately triangular cross section of a height of 0.6 mm. The suspension ring 15 and neck 6 were manufactured from PET. The suspension ring 15 was welded to the neck 6 using an ultrasonic welder type USP-3000/5 KW with Sonotrode TE20 104B2/1 of the firm Telsonic, with a setting of Welding pressure 2.9 bar; Powermax 5562 W; Energy 300 Ws; holdtime 0.5 sec; Sonictime 110 ms. Naturally, also other ultrasonic welding devices can be used and the setting will depend inter alia on the materials used and the geometry used.

The invention is not in any way limited to the embodiments represented in the description and drawings. Many variants within the framework of the invention outlined by the claims are possible. These include all combinations of parts of the embodiments shown. For instance, the container may be wholly or partly formed differently, a different beverage may be packaged and moreover the holder and the pressure device can have any desired shape and dimensions.

The invention claimed is:

1. A holder for beverage, comprising a container manufactured substantially from plastic, provided with a neck having an opening, wherein the container is filled with beverage and on or in the neck a closure is provided, through which closure extends a dispensing device, wherein the closure is fixed to the neck with the aid of at least welding technique and wherein a pressure device is provided inside the beverage container for pressurizing the beverage in the container for dispensing the beverage under pressure via the dispensing device, which pressure device comprises a pressure cartridge filled with gas, as well as a pressure regulating device, wherein the closure comprises a ring shaped element with an opening through which a filling pipe of a filling installation can be inserted, which opening is closed off by a valve mounted after filling of the container with the beverage through said opening.

2. A holder according to claim 1, wherein the closure is fixed to the neck by ultrasonic welding.

3. A holder according to claim 2, wherein the closure comprises a flange provided with an edge and a closing surface, wherein the edge on at least one side of the closing surface stands up to some extent.

4. A holder according to claim 1, wherein the closure comprises a flange with an edge and a central area, wherein the edge is thicker than the central area.

5. A holder according to claim 1, wherein the neck has an opening with a substantially circular cross section with a radius of more than 13 mm or a passage with a cross-sectional area of more than 530 $mm^2$.

6. A holder according to claim 1, wherein the closure is welded onto an upper edge of the neck.

7. A holder according to claim 1, wherein the container is a blown plastic bottle.

8. A holder according to claim 1, wherein the bottle is manufactured from PET or PEN or a blend of PET and/or PEN.

9. A holder according to claim 1, wherein the pressure device is included in the container.

10. A holder according to claim 9, wherein the pressure device comprises a pressure cartridge filled with gas, as well as a pressure regulating device with which gas can be introduced into the container in a dosed manner.

11. A holder according to claim 10, wherein the pressure regulating device is configured for pressure-controlled regulation of the pressure in the container.

12. A holder according to claim 11, wherein the beverage is carbonated beverage and the pressure regulating device is configured for regulating the pressure in the container at approximately the level of an equilibrium pressure of carbon dioxide in the beverage at a temperature between 0 and 15 degrees Centigrade.

13. A holder according to claim 1, wherein the pressure device in the container is suspended from the closure.

14. A holder according to claim 13, wherein the neck has a longitudinal axis and the pressure device is suspended in the container eccentrically with respect to the longitudinal axis.

15. A holder according to claim 14, wherein, viewed in the direction of the longitudinal axis, the pressure device is suspended substantially next to the neck, within the container.

16. The holder according to claim 1, wherein the pressure device has been inserted into the container through the neck prior to welding of the closure to the neck.

17. The holder according to claim 1, wherein the pressure device comprises a storage compartment containing a pressurized gas and a pressure regulating device coupled to the storage compartment, wherein the pressure device is provided in a beverage containing compartment of the container.

18. The holder according to claim 1, wherein the pressure device comprises a storage compartment containing pressurized gas closed off by a valve operable by a pressure regulating unit.

19. The holder according to claim 1, wherein the pressure device extends within the container, spaced apart from the closure, wherein the closure has been welded to the neck.

20. The holder of claim 19, wherein the pressure device extends within a beverage containing compartment of the container.

21. The holder of claim 1, wherein the pressure device is suspended with the aid of the closure, eccentrically of the neck, such that a filling pipe can be inserted into the holder alongside the pressure regulator, through the opening of the ring shaped element and the neck, for filling the holder.

22. The holder according to claim 21, wherein the neck has an opening with a substantially circular cross section with a radius of more than 13 mm or a passage with a cross-sectional area of more than 530 $mm^2$ and wherein the opening in the closure has a smaller cross sectional area.

23. A holder for beverage, comprising a container manufactured substantially from plastic, provided with a neck having an opening, wherein the container is filled with beverage and on or in the neck a closure is provided, through which closure extends a dispensing device, wherein the closure is fixed to the neck with the aid of at least welding technique and wherein a pressure device is provided inside the beverage container for pressurizing the beverage in the container for dispensing the beverage under pressure via the dispensing device, which pressure device comprises a pressure cartridge filled with gas, as well as a pressure regulating device, wherein the closure has an opening through which a filler pipe can be inserted alongside the pressure device.

24. The holder according to claim 23, wherein the neck has an opening with a substantially circular cross section with a radius of more than 13 mm or a passage with a cross-sectional area of more than 530 $mm^2$ and wherein the opening in the closure has a smaller cross sectional area.

25. A holder for beverage, comprising a container manufactured substantially from plastic, provided with a neck having an opening, wherein the container is filled with beverage and on or in the neck a closure is provided, wherein the closure is fixed to the neck with the aid of at least welding technique and wherein a pressure device is provided inside the beverage container for pressurizing the beverage in the container for dispensing the beverage under pressure via the dispensing device, wherein the closure comprises an opening and wherein the pressure device is suspended in the container such that a filler pipe of a filling installation having about the cross section of the opening can be introduced through said opening in the closure alongside the pressure device, wherein further a valve is provided for closing the opening in the closure after filling of the container with the beverage through the filling pipe and removing the filling pipe from the container.

26. The holder according to claim 25, wherein the neck has an opening with a substantially circular cross section with a radius of more than 13 mm or a passage with a cross-sectional area of more than 530 $mm^2$ and wherein the opening in the closure has a smaller cross sectional area.

* * * * *